United States Patent [19]

Hutter et al.

[11] Patent Number: 4,662,693

[45] Date of Patent: May 5, 1987

[54] SHIELDED CONNECTOR FOR SHIELDED COAXIAL INDIVIDUAL CONDUCTORS OF FLAT RIBBON CABLE

[75] Inventors: Harold G. Hutter, Brookfield; Dennis E. Tarrant, Bethel, both of Conn.

[73] Assignee: Allied Corporation, Morris Township, Morris County, N.J.

[21] Appl. No.: 778,584

[22] Filed: Sep. 20, 1985

[51] Int. Cl.[4] ..... H01R 17/18

[52] U.S. Cl. ..... 339/177 R; 339/90 C

[58] Field of Search ..... 339/177 R, 177 E, 17 F, 339/176 MF, 143 R, 14 R, 14 P, 90 C

[56] References Cited

U.S. PATENT DOCUMENTS

| | | | |
|---|---|---|---|
| 3,963,319 | 6/1976 | Schumacher | 339/17 F |
| 4,037,909 | 7/1977 | Trompeter et al. | 339/90 C |
| 4,415,216 | 11/1983 | Narozny | 339/176 MF |
| 4,477,132 | 10/1984 | Moser et al. | 339/177 R |
| 4,480,887 | 11/1984 | Morelli | 339/90 C |
| 4,508,415 | 4/1985 | Bunnell | 339/17 F |
| 4,537,458 | 8/1985 | Worth | 339/17 F |
| 4,563,051 | 1/1986 | Slachetka | 339/143 R |

*Primary Examiner*—Eugene F. Desmond
*Assistant Examiner*—David Pirlot
*Attorney, Agent, or Firm*—Anibal Jose Cortina

[57] ABSTRACT

The invention relates to a terminating connector for use with individual conductors of a shielded coaxial type flat ribbon cable assembly. A bushing is threaded onto the outer sheath of the individual conductors and holds a drain wire which is connected to a shield of the individual conductors between the bushing threads and the outer sheath of the conductor. The bushing is then secured to a shielding housing by means of a securing assembly with the shielding housing including a central contact in insulative isolation therefrom and contacting the central conductor of the conductor. Locking means serve to engage a like locking assembly of a corresponding connector to provide a tight secure shielded connection between the individual conductors of the flat ribbon cable and equipment or other like individual conductors of flat ribbon cable.

8 Claims, 9 Drawing Figures

FIG. 1
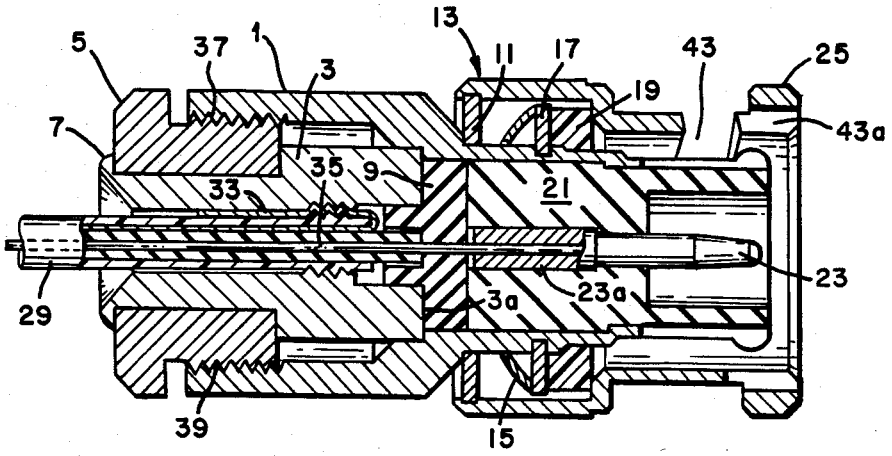
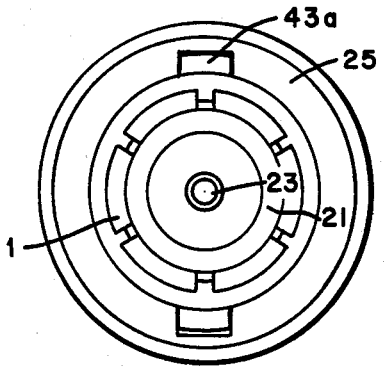
FIG. 2
FIG. 3A
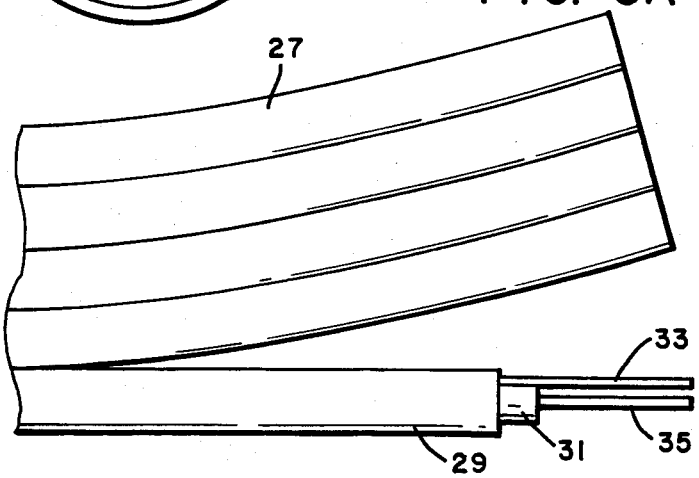

SHIELDED CONNECTOR FOR SHIELDED COAXIAL INDIVIDUAL CONDUCTORS OF FLAT RIBBON CABLE

BACKGROUND OF THE INVENTION

This invention relates to a shielded connector for terminating individual conductors, in a shielded manner, of flat ribbon cable. More particularly, the invention relates to a shielded connector for terminating coaxial type individual conductors of a shielded flat ribbon cable whereby shielding of the conductors is maintained even at the termination thereof.

In the prior art various techniques for terminating single conductor coaxial cables of the shielded type are known. More particularly, the techniques and devices are generally employed for terminating typically, coaxial cables of a size rated as 75 ohm cable as well known to those of ordinary skill in the art. These coaxial cables are generally made up of a central copper conductor or other conductor material surrounded by an insulating layer or a layer of dielectric material of cylindrical shape around the central conductor. This layer is in turn surrounded by a shielding cylindrical tubular metallic braid which forms an outer conductor of the coaxial cable. The outer tubular conductor is generally in turn covered with a cylindrical layer of insulation which is made of a material having, in addition to its insulating properties, a good mechanical and weather resistance.

These coaxial cables are typically large enough that they can be easily terminated by simple structures. In preparation to attaching a connector to such a coaxial cable, the cable is first dressed by removing the outer covering for a predetermined distance from the end of the cable. The braided conductor and inner dielectric layer are then cut off at a different predetermined distance to expose the central conductor, and the braided conductor is then folded over the outer layer, and the connector slipped over the entire assembly to establish electrical connection between the outer body of the connector and the braided conductor as well as between the central conductor and an isolated central conductor part of the connector body. The connector is then crimped onto the outside of the cable to hold the braided conductor against the exterior of the cable and thereby effect secure termination and attachment to the end of the cable.

Such typical cable terminating connectors are employed in numerous high frequency radio wave applications at the input of a radio receiver or output of a radio transmitter and/or television antenna applications. As noted these connectors are simple one piece connectors and are well known to those of ordinary skill in the art.

In other applications which require secure shielding and connection to a like connector or device, such as for example, computer applications and/or oscilloscope-type applications, a different type of connector is employed which involves a slot-type engagement mechanism whereby the engagement mechanism of the connector is spring loaded to effect secure connection. The connecting operation typically provides that an engagement portion is rotated in the coupling of slots of the connector with projections of the connector to which it is to be connected. These connectors are also well known in the art and are used extensively to terminate the above-discussed coaxial cables in specialty applications.

Other variations in coaxial-cable shielded-type connectors are disclosed in U.S. Pat. Nos. 3,488,625, 3,697,930 and 4,243,290. The environment in which all of these connectors are employed is in use with relatively large coaxial cables such as the 75 ohm cables discussed above. It is relatively easy with said connectors to terminate such cables due to the fact that the metallic braid is relatively large and can be easily folded over the external sheath of the cable and thereby attached to the outer shield of the connector.

On the other hand, in more recent times, it has been found that in the environment of computer communications wherein flat multi-conductor cables are employed, radio frequency interference is often a problem. Typically in the past the flat multi-conductor cables have not employed shielded coaxial-type individual conductors and thus, the use of the shielded terminating connector was never contemplated since to employ it would be to no avail since the cable conductors themselves were not shielded throughout the length thereof and thus, subject to significant RF interference. An example of this is found in office environments wherein typically cable lengths between individual computers and/or peripheral devices were limited to no more than about 50 feet due to the extensive interference caused by high noise office environments, and which typically resulted in disruption of computer communications.

In recognition of the problem, in more recent times, there has been developed a flat ribbon cable employing coaxial-type shielded individual conductors. One example of such a flat ribbon cable coaxial assembly is disclosed in U.S. Pat. No. 3,775,552 to Schumacher. In such flat ribbon cable assemblies, each conductor section of the flat ribbon cable is generally separable as an entity from the remainder of the flat ribbon cable. Once separated, the conductor sections will, as in the case with the 75 ohm-type larger size conductors, include a central conductor such as a copper wire. This copper wire is surrounded by a jacket of cylindrical shape which is made of insulating material and/or dielectric material. The dielectric is typically polytetrafluoroethylene, commonly available under the trademark Teflon® from Dupont Corporation. This dielectric is then wrapped with a thin braid of aluminized mylar employed for shielding, and having a drain wire in contact therewith which is a single strand of wire running parallel to the center conductor and in conjunction with the aluminized mylar wrap. The outer jacket is then also of insulating material, and is weather resistant, and when forming part of the ribbon cable is attached to other like outer jackets of similar conductors as will be readily apparent to those of ordinary skill in the art.

Although providing individually shielded conductors for a flat ribbon cable, due to the relatively smaller size of such conductors as compared to typical 75 ohm conductors, it becomes difficult to terminate the individual conductors and still maintain effective shielding for the cable assembly. More particularly, in dressing the end of the conductor, the mylar, due to it being a very thin layer, cannot be terminated properly to permit folding over and thus, one has to rely on the drain wire to provide the conductive path to the terminating connector to complete the shielding. However, there has been no readily apparent way to insure secure attachment to such small individual conductors without severing the conductors and/or causing serious defects in the conductor and thus, detrimentally affecting shielding thereof.

SUMMARY OF THE INVENTION

It is thus an object of the present invention to provide a shielded terminating connector for individual conductors of the shielded coaxial type of a flat ribbon cable.

It is another object of the present invention to provide such a terminating connector which is of simple construction and easy to assemble in terminating such individual conductors of a flat ribbon cable.

It is still another object of the present invention to provide such a terminating connector which provides a high attachment force to prevent its detachment from the individual conductors of a coaxial-type flat ribbon cable.

These and other objects of the present invention will become more readily apparent as the same becomes better understood from the following summary and detailed discussion of the invention made with reference to the attached claims and drawings.

In accordance with the invention there is provided a terminating connector for terminating individual shielded conductors of flat ribbon coaxial cable. The flat ribbon coaxial cable is of the type wherein each conductor includes a central conducting means wrapped by insulating means which is in turn wrapped by shielding means in electrical contact with a drain, which is coextensive therewith, and with the entire assembly being wrapped by a cover insulator. The connector comprises a bushing for fitting over the end of an individual conductor of the shielded flat ribbon cable over the cover insulator of the individual conductor. The connector bushing is such that the drain means establishes electrical contact with the connector bushing, and engages the cover of the individual conductor assembly with a force sufficient to prevent its detachment therefrom by pulling.

The connector further includes a body which is connected to the bushing in electrical contact therewith and comprises connector engaging means for engaging a complementary connector in a manner shielding the central conductor of the individual conductors of the flat ribbon cable. A contact serves to establish electrical contact with the central conductor of the individual flat ribbon cable conductors and for establishing electrical contact with a central contact of a complementary connector. The contact is mounted within the body in an insulative manner with respect to the exterior shielding portion of the body whereby the assembly forms a shielded connector for the central conductor of the individual conductors of the flat ribbon cable.

In a more specific aspect, the bushing of the invention includes threads so that it is threadingly received over the external sheath or cover of the individual conductors, and retains the drain, which is a wire folded over the exterior sheath, between the threads and the exterior sheath of the individual conductors. A threaded sleeve is received also on the exterior of the individual conductors behind the bushing and threads onto complementary threads of the housing of the connector. This sleeve is received over the bushing and in electrical contact therewith. Accordingly, the connector housing is thus able to provide the shielding effect in combination with the shield of the individual conductor.

Inside the connector housing is also placed an insulating material, for example, Teflon which includes projecting therethrough a contact which extends out towards the front of the connector housing to establish electrical connection with a complementary receiving contact of another connector. This contact extends through the center of the insulator and is thus kept from electrical contact with the external shielding housing, and is spaced therefrom and shielded thereby to permit transmissions through the contact without RF interference. The contact is primarily a cylindrical prong having a passage in the center thereof and a portion which serves to receive the central conductor of the individual conductor of the flat ribbon cable. The contact includes a crimpable portion which is crimped to insure continuous contact with said central conductor.

In a still further aspect the housing includes a spring loaded engaging portion with a slot-like mechanism whereby it can be locked onto a like connector to insure a fully shielded electrical connection for the individual conductors of the flat ribbon cable.

BRIEF DESCRIPTION OF THE DRAWINGS

Having briefly described the invention, the same will become better understood from the following detailed discussion of the invention made with reference to the drawings wherein:

FIG. 1 illustrates a side cross-sectional view of the fully assembled connector in accordance with the invention;

FIG. 2 illustrates a front view from the connecting end of the connector in accordance with the invention;

FIGS. 3A to 3D show a four step assembly of the connector in accordance with the invention, shown terminating a dressed end of an individual conductor of a coaxial shielded-type flat cable assembly;

DETAILED DISCUSSION OF THE INVENTION

Figure 3B:
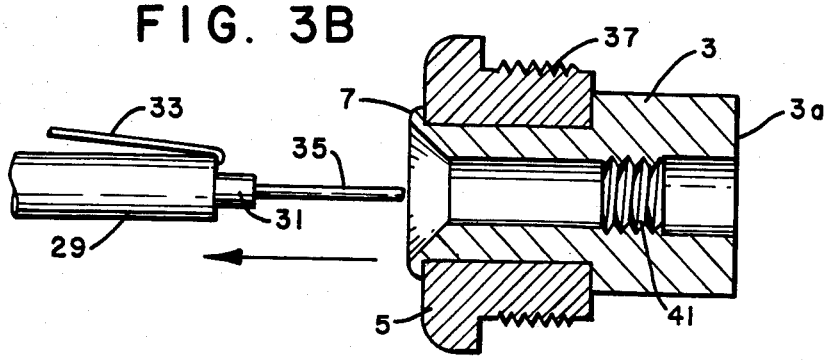

In FIG. 1 there is shown an assembled view of the connector in accordance with the invention shown connected to an individual conductor of a multiconductor flat ribbon cable. As shown therein, the connector includes a bushing 3 which is threadingly received on the exterior of an individual conductor of a multiconductor flat ribbon cable. The bushing 3 is in electrical or conductive connection with a shield of the individual conductor as will be discussed hereinafter, and is also threadingly received on the exterior sheath of the individual conductor as will also be discussed hereinafter.

Over the rear portion of the bushing 3 is received an outer sleeve 5 which is held on the rear portion of the bushing 3 by, optional, turned-out tabs 7. The outer sleeve 5 includes threads 37 which thread onto corresponding threads of a connector housing 1 and serve to establish electrical connection between the connector housing 1 and the bushing 3 and the shield of the individual conductor. The housing 1 projects forward and includes an abutment for the front end 3*a* of the bushing 3 which serves as the stop for forward movement of the bushing 3 upon threading of the outer sleeve 5 into the housing 1.

Within the housing 1 is received a two-part insulator 9 and 21 which includes a contact 23 including a crimpable portion 23*a* for establishing electrical contact with a central conductor 35 of an individual conductor of the flat ribbon cable. The crimpable portion 23*a* is crimped onto said central conductor 35 so that the contact 23 can then be employed for connection to a receiving contact of another connector.

Rotatably received outside the main housing 1 is a forwardly extending connecting sleeve 25 of locking housing 13 which is spring loaded to the housing 1 to thereby be locked to a complementary connector upon engagement therewith. More particularly, the connecting sleeve 25 of locking housing 13 is rotatably held on housing 1 by means of a washer 11 at one position cooperating with a ring 17 supported by a gasket 19, and spring loaded by means of spring washer 15. In connecting to a complementary connector, slot 43 is provided in connection with passage 43*a* which engages with a complementary tab or projection of another connector, and to effect the locking connection one merely has to rotate the locking housing 13 to cause the projection of the another connector to compress spring washer 15 by means of engagement with slot 43. This type of engagement mechanism is conventional and well known to those of ordinary skill in the art and need not be discussed in further detail herein.

With respect to the assembly of the device of the invention, the sequence is more clearly shown in four steps in FIGS. 3A to 3D. More particularly, initially a flat multi-conductor coaxial shielded cable assembly 27 has an individual conductor assembly as shown, separated therefrom in a conventional manner. The conductor assembly includes a central conductor 35 which is typically a copper wire or wires, or other like conductor material. An insulating or dielectric material 31 surrounds the central conductor 35, which insulating or dielectric material is typically Teflon® or other type dielectric. Surrounding said dielectric 31 there is a thin sheet, preferably aluminized mylar which provides a shielding effect. The sheet is not shown since it does not project outwardly from the dressed conductor assembly. However, this sheet is in electrical contact with a single filament wire 33 which extends parallel to the central conductor 35. The central conductor 35, dielectric 31 and wire 33 assembly is then wrapped by another insulator 29 which forms its outer coating and is typically a weather-resistant material in addition to having insulating properties.

For assembly in termination of the individual conductor assemblies, the wire 33, which is a drain wire, is folded over the outer insulating cover 29 and the bushing 3 is threaded by threads 41, whose construction will be later discussed, onto the exterior sheath or cover 29. Accordingly, the threads 41 will then serve to establish electrical contact between the drain wire 33 and the bushing 3 by holding the drain wire 33 between the threads 41 and the outer cover 29 of the individual conductor assembly.

In a preferred embodiment as shown in FIG. 3B, the outer sleeve 5 is held on the bushing simultaneously by the turned-out tabs 7. Alternatively, said sleeve could merely be placed over the conductor assembly with the bushing then being threaded thereon so that the sleeve could pass over the end of and engage the bushing 3 and thereby serve to attach it to the main housing 1.

Figure 3C:
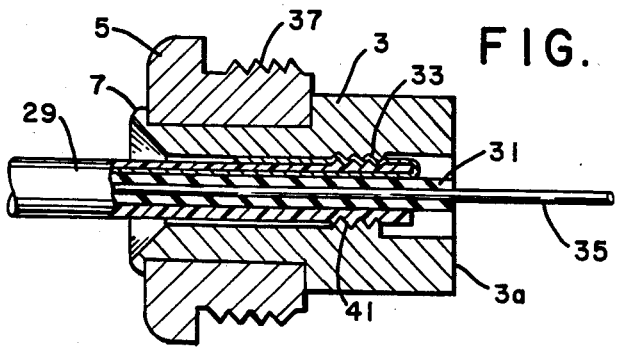
Figure 3D:
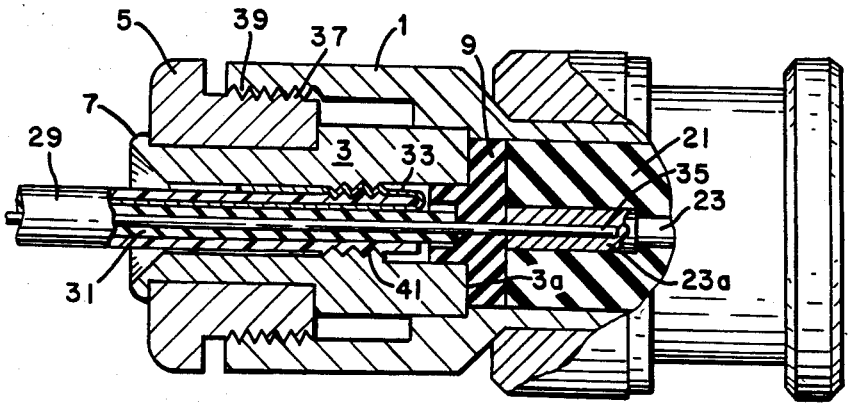

In FIG. 3C, step 3 is shown with the bushing 3 already threaded over the individual conductor assembly and holding the drain 33. As can be seen, the Teflon® or dielectric material 31 terminates at the end of the bushing with the central conductor 35 projecting a predetermined distance therefrom. Thereafter, as shown in FIG. 3D, which corresponds to step 4, the bushing 3 outer sleeve 5 assembly is then threaded onto the main housing 1 to complete the connector assembly.

In this regard, it is noted that the crimping portion of the contact 23 was previously discussed. The contact 23 extends from and is connected to an insulating dielectric 9 through the center thereof such that prior to assembly, the crimping portion 23 can be crimped onto conductor 35. Thereafter, the second dielectric insulating portion 21 is then passed, with a bore therethrough over the contact 23 such that the housing 1 can then be passed over that assembly and threaded by its threads 39 onto threads 37 of the outer sleeve 35.

Figure 4:
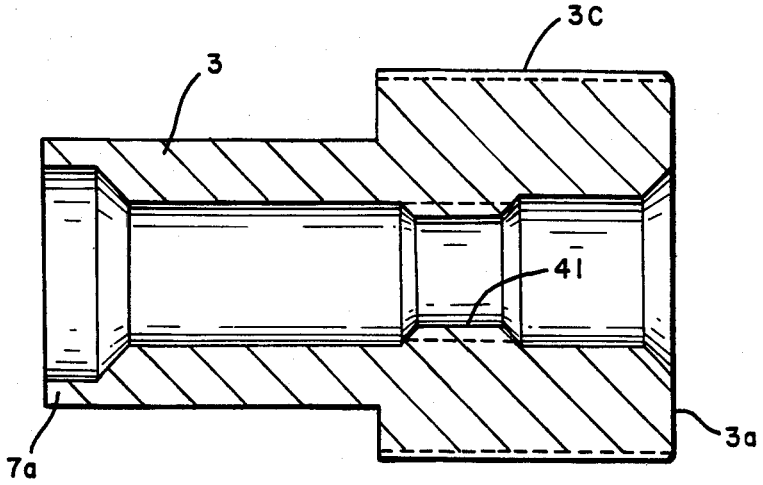
FIG. 4 is a side cross-sectional view of the bushing having the threads for being threaded onto the individual conductor outer sheath for use in the connector of the invention.

With respect to the bushing 3 itself, this is shown in greater detail in FIG. 4 with the threads identified as 41. It is noted that the bushing 3 includes a larger diameter portion including a roughened surface 3*c* to permit ease of threading by a user's fingers. The turned-out tabs are generally made from narrowed portions 7*a* at the tail of the bushing 3, which narrowed portions can be turned out to hold the outer sleeve 5 on the bushing 3 in a conventional manner as will be well known to those of ordinary skill in the art.

Figure 5:
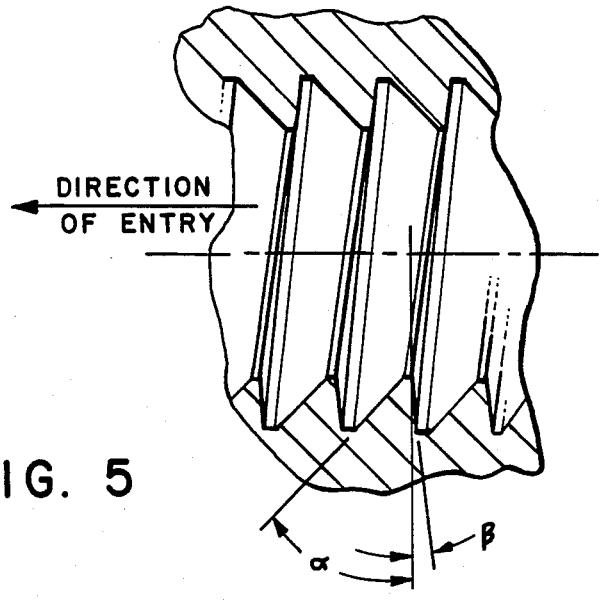
FIG. 5 shows a partial cross-sectional view of the internal thread configuration of the bushing of FIG. 4.
Figure 6:
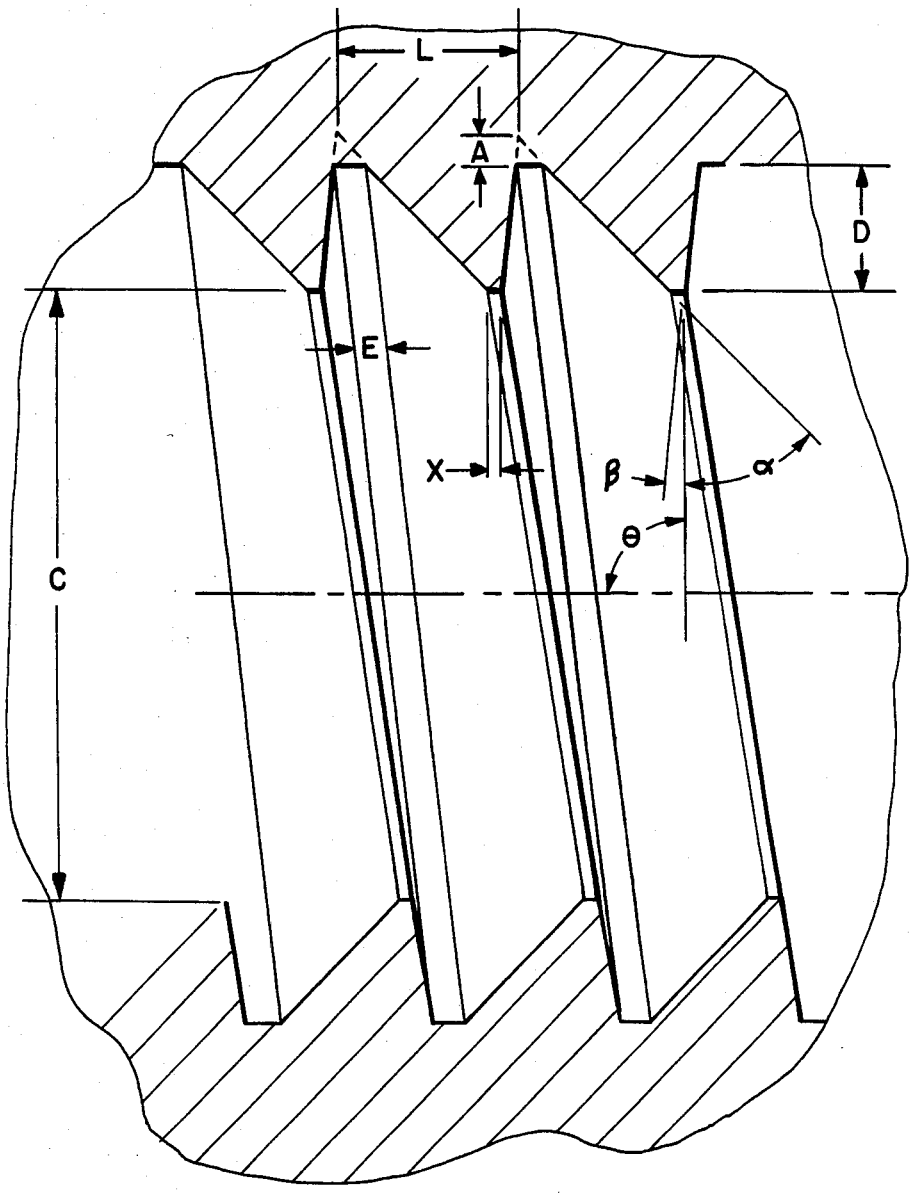
FIG. 6 is an enlarged view of FIG. 5 showing the various relationships between the portions of the novel thread construction of the connector bushing of the invention.

Although conventional inner threads 41 can be employed with the bushing 3, a preferred thread arrangement is shown in FIG. 5 and enlarged FIG. 6. In FIG. 5 the thread is shown in the form typically known as a "buttress" thread. This thread includes predetermined relationships between the angles of the threads wherein on one side of the thread an angle $\alpha$ is formed with a perpendicular cross-axis thereof and on the other side an angle $\beta$ is also formed with the perpendicular cross axis thereto. It is preferred that the angle $\alpha$ equal approximately 45° while the angle $\beta$ should equal approximately 7°.

As further shown in FIG. 6, individual lands or plateaus of a spacing E are provided which aids in increasing the pulling force of the bushing on the outer sheath 29 of the individual conductors. This is further complemented by selecting the distance between the ends of the plateaus or lands to fall within a predetermined range L in accordance with the size of the individual conductors employed. In FIG. 6, $\theta$ is the perpendicular cross axis angle to the longitudinal axis and typically will equal 90° and serves as a reference to define the angles $\beta$ and $\alpha$.

As a further feature of the invention, it is noted that the threads at their peak should not terminate as a sharp peak or edge and instead, should also provide a plateau of a predetermined width X as shown in FIG. 6. The depth of the threads themselves are of a predetermined widths D which should be of a size sufficient to engage the outer sheath 29 without penetrating or destroying it and thus, provides sufficient holding power for the bushing. This predetermined distance D is selected with reference to an inner diameter C of the threads taking into consideration the thickness of the sheath or cover 29 of the conductor assembly.

As a further feature, it is noted that before each rise portion of each thread, there is a plateau at the bottom of each thread which is of a predetermined width E. All of the widths and sizes are selected taking into account the features of the conductor assembly upon which it is to be employed and the illustrations of the features are intended merely for the purpose of discussing a general preferred configuration for the threads as opposed to a conventional threading, as employed, for example, in the threading of the housing 1 to the outer sleeve 5.

While particular embodiments of the present invention have been shown and described, it will be obvious to those skilled in the art that various changes and modifications may be made without departing from the scope of the invention and its aspects. Accordingly, the aim of the appended claims is to cover all such changes and modifications as may fall within the true spirit and scope of the invention.

What is claimed is:

1. A terminating connector for terminating individual shielded conductors of flat ribbon coaxial cable of the type wherein each conductor includes a central conducting means wrapped by insulating means which is in turn wrapped by shielding means in electrical contact with drain means coextensive therewith, and the entire assembly being wrapped by cover insulating means, the connector comprising:

bushing means for fitting over the end of an individual conductor of a shielded flat ribbon cable over the cover insulating means thereof for establishing electrical contact with said drain means, and having conductor engaging means for being attached to said individual conductor at the cover insulating means thereof, and said bushing means comprising a bushing having inner threads for being threaded onto the cover insulating means of an individual conductor;

body means for being connected to said bushing means in electrical contact therewith, and comprising connector engaging means for engaging a complementary connector in a manner shielding the central conducting means of said individual conductor; and contact means for establishing electrical contact with said individual conductor central conducting means, and for electrically contacting contact means of a complementary connector, and said contact means being mounted within said body means in insulative relationship with respect thereto, whereby said assembly forms a shielded connector for said central conducting means of said individual conductor of flat ribbon coaxial cable.

2. A connector as in claim 1 wherein said insulating means is made of Teflon ®.

3. A connector as in claim 1 wherein the drain means is a drain wire in electrical contact with a conductive shielding sheath around the insulating means, the drain wire being folded over the exterior of the individual conductor and held between the cover and the bushing by the threads of the bushing to establish electrical contact with the bushing.

4. A connector as in claim 3 wherein said threads are buttress threads.

5. A connector as in claim 3 wherein said bushing is secured to the body means by a sleeve threaded to the body means and holding the bushing between the sleeve and the body means to establish shielding electrical connection with the body means.

6. A connector as in claim 5 wherein said sleeve is held on the rear portion of the bushing by tab engaging means.

7. A connector as in claim 1 wherein said connector engaging means is a slot in an engaging sleeve mounted on said body means whereby a tab of a complimentary connector is engaged in said slot and locking engagement effected by rotation of said engaging sleeve.

8. A connector as in claim 7 wherein said slot is oriented at an angle to the transverse axis of the connector and said engaging sleeve is spring loaded.

* * * * *